United States Patent [19]

Harris

[11] 4,114,817

[45] Sep. 19, 1978

[54] GRANULATOR

[75] Inventor: Fred A. Harris, Cleveland, Tenn.

[73] Assignee: Olin Corporation, New Haven, Conn.

[21] Appl. No.: 797,163

[22] Filed: May 16, 1977

[51] Int. Cl.[2] ..... B02C 13/13

[52] U.S. Cl. ..... 241/73; 241/89.2; 241/191

[58] Field of Search ..... 241/32, 73, 89, 89.1, 241/89.2, 189 R, 239, 240, 241

[56] References Cited

U.S. PATENT DOCUMENTS

| | | | |
|---|---|---|---|
| 1,737,444 | 11/1929 | Wilson | 241/73 |
| 2,919,075 | 12/1959 | Pfeiffer | 241/160 |
| 2,960,988 | 11/1960 | Peterson | 241/32 |
| 3,502,276 | 3/1970 | Panning et al. | 241/111 |

*Primary Examiner*—Granville Y. Custer, Jr.
*Attorney, Agent, or Firm*—Bruce E. Burdick; Donald F. Clements; Thomas P. O'Day

[57] ABSTRACT

An improved granulator is disclosed having housing defining a granulation zone. A screen is attached to the housing within this zone and a contactor device moves repeatedly toward the screen to force material through the screen. A retractor device moves the screen and contactor apart when a predetermined force is reached therebetween. A shear pin sprocket drive connection can be employed to inactivate the contactor when a predetermined force is applied thereto.

3 Claims, 15 Drawing Figures

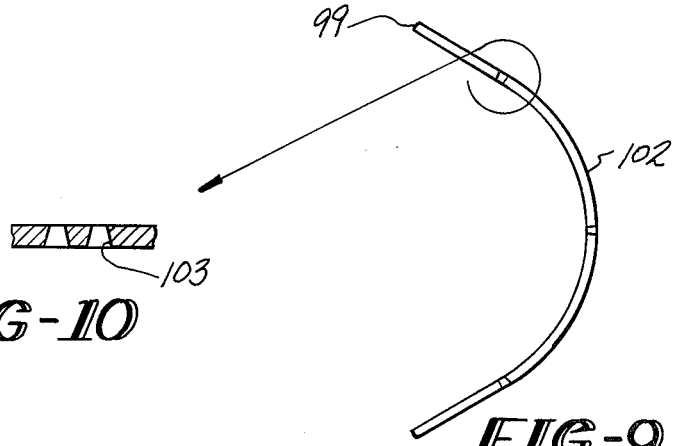
FIG-10
FIG-9
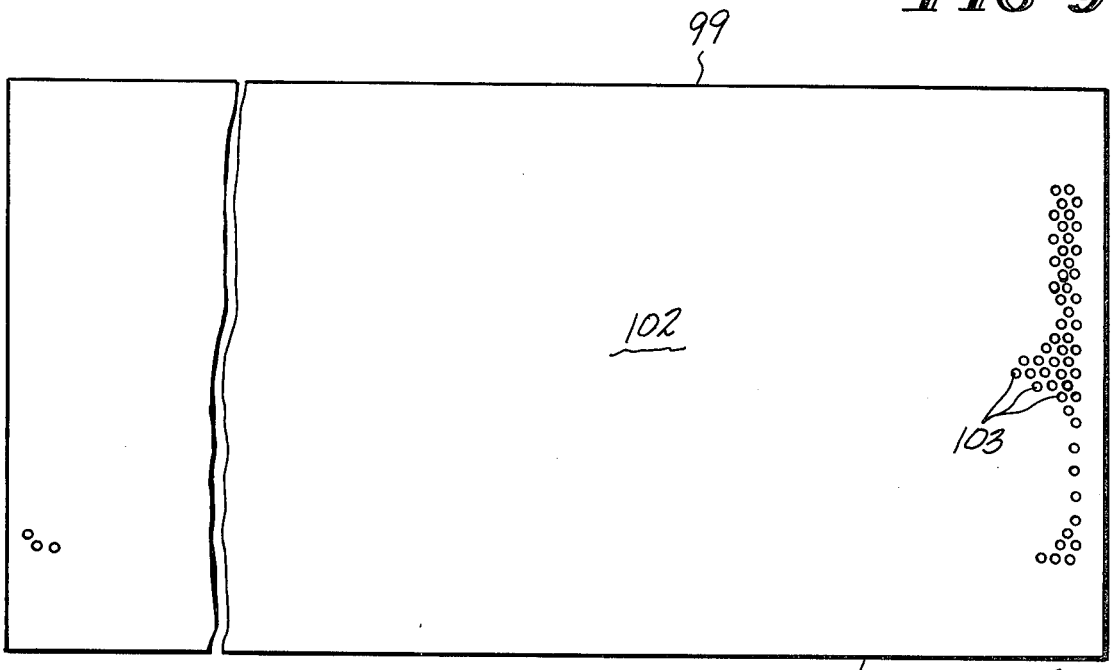
FIG-8
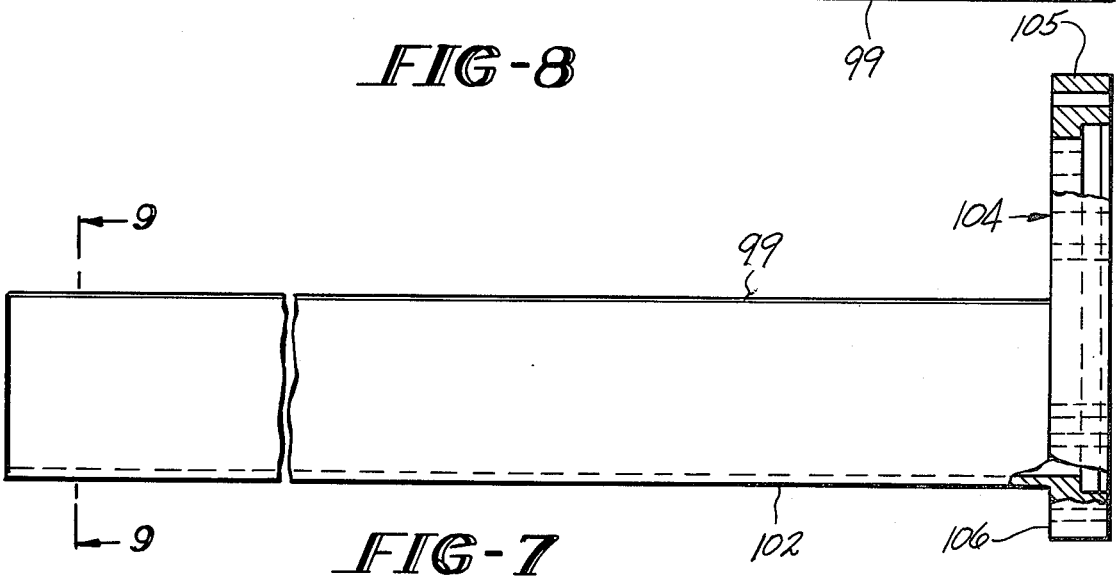
FIG-7

GRANULATOR

This invention relates to material handling and more specifically to granulation apparatus.

Granulation, as used herein, means the process of size reduction to granular particles. One use of granulation is the size reduction of preform flakes from rolls utilized in otherwise conventional manufacturing processes for the production of calcium hypochlorite, a chemical sold in granular form under the registered trademark HTH for use in water sanitization such as in chlorinating swimming pools. Typically such a preform flake is a moisture-laden sheet of material which is fed by a scroll-type conveyor or other suitable feed means to a dryer. A granulator can be utilized to reduce the size of the particles fed by the feed means to predetermined granular sizes. This is important because calcium hypochlorite is somewhat unstable when heated and tends to decompose more rapidly when in large particles which may retain more moisture than smaller particles. The granulator can lower the likelihood of such decomposition by yielding a more uniform product distribution.

Several granulation devices are commonly available, but for various reasons are not suitable for granulation of calcium hypochlorite preform flakes. One such granulator, commonly referred to as a "hammer-mill", has a vertically mounted shaft with radial hammers projecting horizontally therefrom. The shaft rotates at an extremely high speed, such as 1800 RPM, and literally slaps the input material to pieces and forces it through a vertically mounted screen. If a foreign metallic object inadvertently enters the device, it is apparent that the high speed hammers, the shaft or the screen are likely to be damaged. Also, the flake is so severely slapped that an inordinate amount of overly fine particles can be produced. These unwanted fine particles or "fines" are generally withdrawn and recycled through the process so as to create a less "dusty" product, for if the final product is too finely particulated, the ultimate consumer can have problems with the product blowing during windy conditions or dissolving less readily in water, as described in U.S. Pat. No. 2,195,754 issued Apr. 2, 1940 to Robson and Kaufmann. Also, the more frangible, drier pieces are immediately thrown out of the top area of the screen while the more plastic wet pieces continue down until ground small enough to escape through the screen, thereby resulting in a product which may be undesirably separated into wet and dry components, resulting in uneven drying in subsequent drying operations.

Another type of prior art granulator has a horizontally mounted shaft with vertical radially projecting spaced blades projecting therefrom to slice the input material as well as "slap" the input material at an angle through openings of a screen. The particle size distribution of the screened particles is controlled by at least these four factors: screen-opening size, screen thickness, rotational speed of the blade and sharpness of the blade. These aspects are varied so as to achieve the desired particle size distribution. However, that device is primarily an impact mill and is thus subject to damage, and especially blade and screen damage, in the event a foreign object, such as a tool, stray bolt, washer, nut or screw enters the granulator, despite the inclusion of an overload-preventing ammeter, since the impact-mill with its relatively high speed blades may knock such an object through the screen before the overload ammeter trips and the blades cease rotating. There is thus a need for better protection against such damage whether caused by inadvertence or deliberate sabotage.

A third prior art granulator has a horizontal rotor-cage comprised of horizontal wires or rods mounted on horizontal shafts which rotates at relatively low speed to abrasively squeeze crumbleable input materials through screen openings to produce a given particle size distribution. No provision is made for overload or for handling foreign objects.

An additional area of concern is the proper distribution of granulated material from the granulator onto individual trays of a dryer. One type of dryer currently utilized for drying granulated calcium hypochlorite is a Wyssmont type tray dryer having a hollow cylindrical housing closed at its lower end by a frustoconical collector leading to an outlet for withdrawal of material from the dryer. A plurality of wedge-shaped pans are attached to a rotating central shaft in a staggered multi-leveled configuration and project outwardly therefrom. The dryer housing is stationary and includes supports for a plurality of scraper bars adapted to push material from one tray into a space between said tray and an adjacent tray and onto another tray staggered therebelow at a lower level so as to continuously move material downward through the dryer until the material eventually reaches the collector where it is fed to another process step. The wedge-shaped design of such dryer trays presents a product delivery problem in that the granulated material should be deposited on the trays uniformly so as to avoid excess material on the thin inner end of the trays which could drop through the dryer without being significantly dried.

A further problem is that of removal of the granulator screen for servicing or replacement, since the granulator screen is subject to the abrasive and corrosive action of the material being granulated as the material passes through the screen, and therefore must be periodically replaced. In prior art granulators, screen removal is a complicated process, often requiring disassembly of rotors, access panels or the screen clamping mechanism itself. A means is needed to simplify the removal of the granulator screen.

These and other problems are solved by the apparatus of the invention which provides a granulator comprising:

a. a housing means, having an entrance and an exit, for defining a granulation zone therewithin;
b. screen means, adapted to be attached to said housing, for dividing said granulation zone into an inlet region and an outlet region;
c. contactor means for repeatedly moving within said inlet zone and toward said screen means so as to contact a portion of any material within said contact zone and exert a force on said portion so as to tend to move said portion through said screen means and into said outlet region, and
d. retractor means, attached to at least one of said screen, housing and contactor means, for moving at least one of said contactor means and said screen means away from the other of said contactor means and housing means responsive to said force reaching a predetermined magnitude.

Another aspect of the invention provides a granulator comprising:

a. upper and lower housing means for jointly defining a granulation zone;

b. screen means clamped between portions of said upper and lower housing;

c. separator means, attached to said upper and lower housings, for selectively providing limited separation between said upper and lower housings sufficient to allow sliding removal of said screen from between said upper and lower housings, and d. beater assembly means for repeatedly passing a beater bar within said granulation zone in close proximity to said clamped screen so as to force a portion of any material between said beater bar and said screen means downwardly through said screen means.

The objects and advantages of the invention will become apparent after consideration of the attached drawing in which:

FIG. 7 is a front elevational view of the screen of FIGS. 4 and 6;

FIG. 8 is a top plan view of the screen of FIG. 7 with the perforated portion shown lying flat;

FIG. 9 is a cross-sectional view of the screen of FIG. 7 taken along lines 9—9;

FIG. 10 is an exploded view of the screen openings of FIGS. 7, 8 and 9;

The drawings describe a preferred embodiment by way of example and not by way of limitation. With this in mind, the preferred embodiments will now be described in detail.

Figure 1:
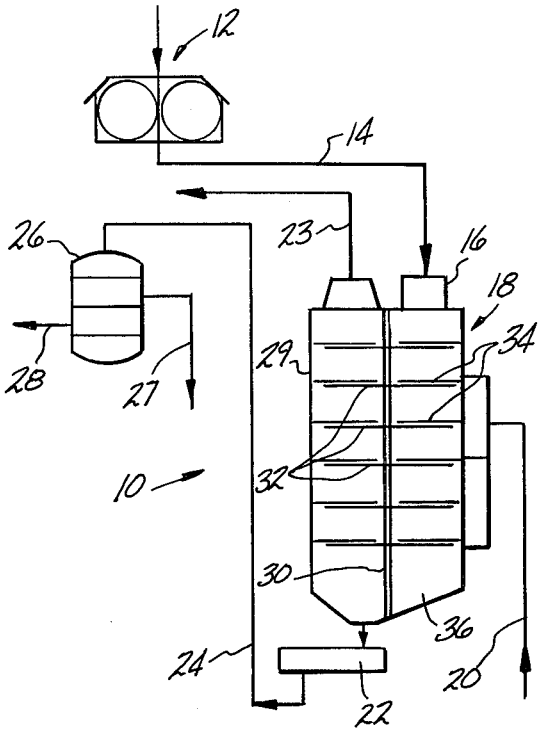
FIG. 1 is a schematic representation showing the context of the invention.

FIG. 1 shows a portion 10 of a manufacturing process for the production of dry granules of calcium hypochlorite, a chemical compound predominantly sold under the registered trademark HTH. Portion 10 comprises preform rolls 12, scroll conveyor 14, granulator 16, tray dryer 18, heated air supply 20, cooler 22, scalper feed line 24, scalper screen 26, oversize return line 27 and outlet line 28. Preform rolls 12 serve to densify or compact the product of a conventional calcium hypochlorite manufacturing process producing an intermediate moisture-laden product which is fed into rolls 12 and compacted and then fed to scroll conveyor 14, of conventional design. Scroll 14, which can also be any other suitable material transfer device, feeds the product from preform rolls 12, such product being commercially referred to as "preform flake", to granulator 16, which is the subject of this invention. Granulator 16 granulates this preform flake into granules of suitable size and feeds these granules to tray dryer 18 by heated air supplied from hot air supply 20 to reduce the moisture content thereof to a suitable level for the final product. Tray dryer 18 can be of conventional design, such as the Wyssmont type, which includes outer housing 29, a vertical shaft 30, trays 32, scraper bars 34 and a slope collector 36. Trays 32 extend radially from shaft 30 and pass closely under scraper bars 34. As shaft 30 rotates, scraper bars 34 remove any excess material from trays 32. Trays 32 are in a staggered vertical relationship so that product scraped from one tray will fall to the next tray therebelow, rather than passing completely through the dryer and onto collector 36. The calcium hypochlorite granules thus slowly move downwardly through dryer 18, eventually being deposited on collector 36 and transferred to cooler 22. Cooler 22 serves to reduce the temperature of the calcium hypochlorite particles exiting tray dryer 18 and passes the cooled granules to a suitable feed line 24 leading to scalper screen 26. Scalper screen 26 serves to screen out or "scalp" any oversize granules and feed these oversize granules to an oversize return line 27. The remainder of the granules pass through scalper screen 26 and into an outlet line 28 leading to further process steps not shown.

Figure 2:
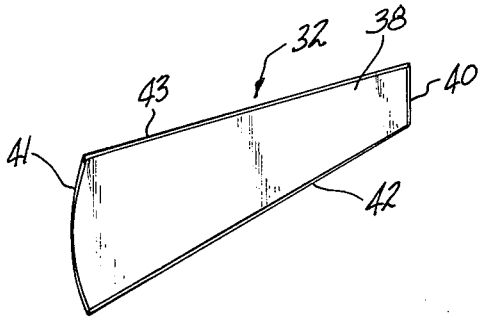
FIG. 2 is an isometric view of a typical dryer tray utilized with the invention.

The individual trays 32 of tray dryer 18 are conventionally of a wedged shape and comprise bottom 38 inner wall 40, outer wall 41 and side walls 42 and 43, as best seen in FIG. 2. Bottom 38 is solid or of screen of a fine mesh size to only allow extremely fine particles to pass therethrough. It is desirable that the granules held within tray 32 be uniformly distributed along the surface thereof so that a minimum amount of granules are scraped over inner wall 40, for reasons described below.

Figure 3:
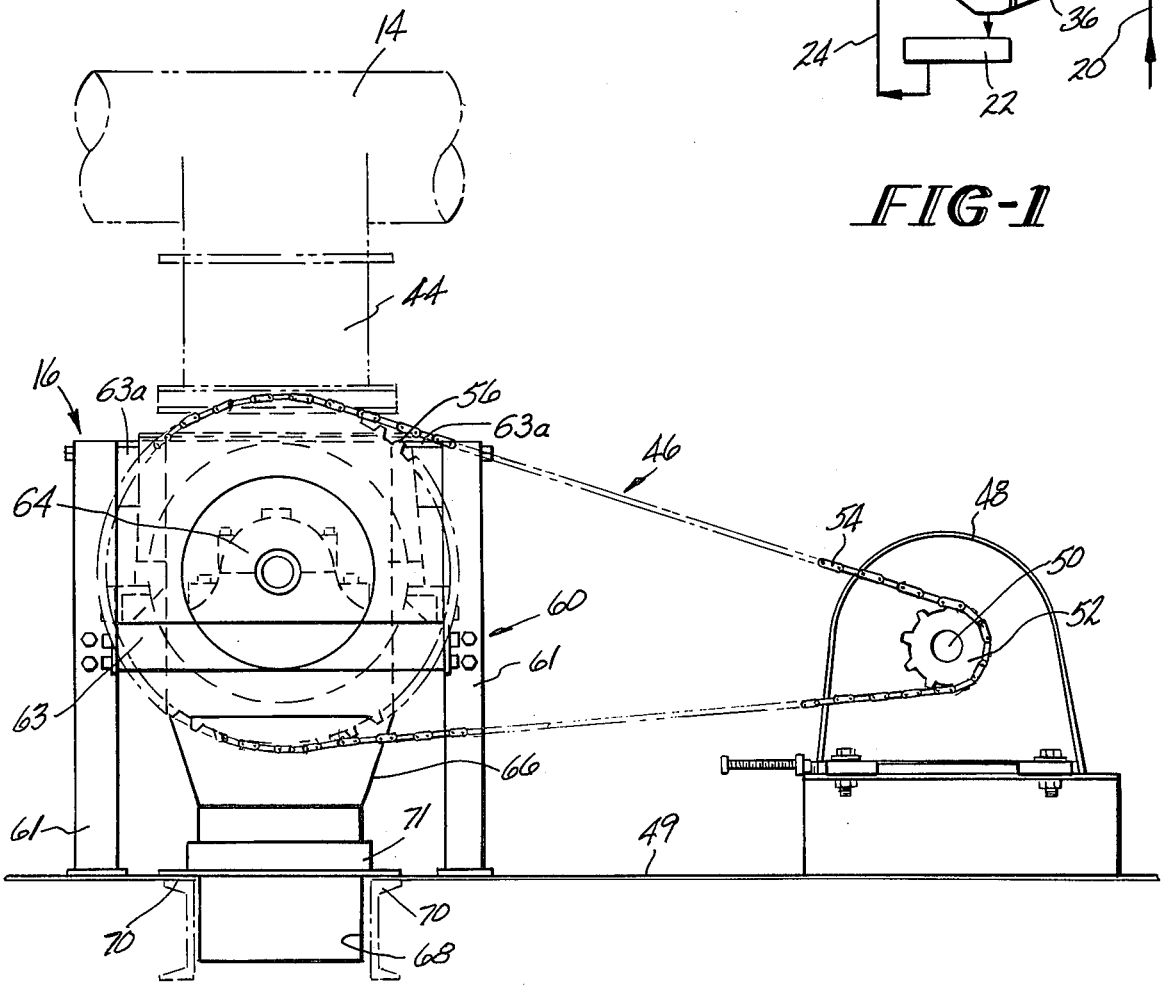
FIG. 3 is a vertical side view of the granulator of the invention showing a drive means.

Referring now to FIG. 3, the preform flake is fed from scroll conveyor 14, or other suitable conveyor means, to granulator 16 through a feed chute 44. Granulator 16 is driven by a drive means 46 which comprises drive circuit 47 (FIG. 14), motor 48, drive shaft 50, drive sprocket 52, drive chain 54, driven sprocket 56 and driven shaft 58. Motor 48 is preferably an electrically powered motor of conventional design. Drive sprocket 52 and drive sprocket 56 can be suitably sized so as to provide a desired amount of torque to drive shaft 58. Motor 48 can be mounted to the top 49 of dryer 18, while driven shaft 58 is preferably mounted within a bearing 64 to reduce frictional force. Bearing 64 can be mounted to a framework 60 which also could be mounted to the top 49 of dryer 18. Framework 60 comprises legs 61 and crossbars 63, 63*a* and 63*b* and is adapted to support the driven portion 16*a* of granulator 16. Driven sprocket 56 is attached to driven shaft 58 by a conventional shear pin in order to limit the amount of torque that can be applied to shaft 58. Top 49 of dryer 18 is provided with support ribs 70 and a suitable opening therebetween to allow a chute extension 68 of an outlet chute 66 of granulator 16 to pass therethrough. A suitable flashing 71 can be utilized within this opening to minimize clearances in order to decrease the amount of dust and heated air escaping between chute 68 and top 49.

Figures 4, 5, 6:
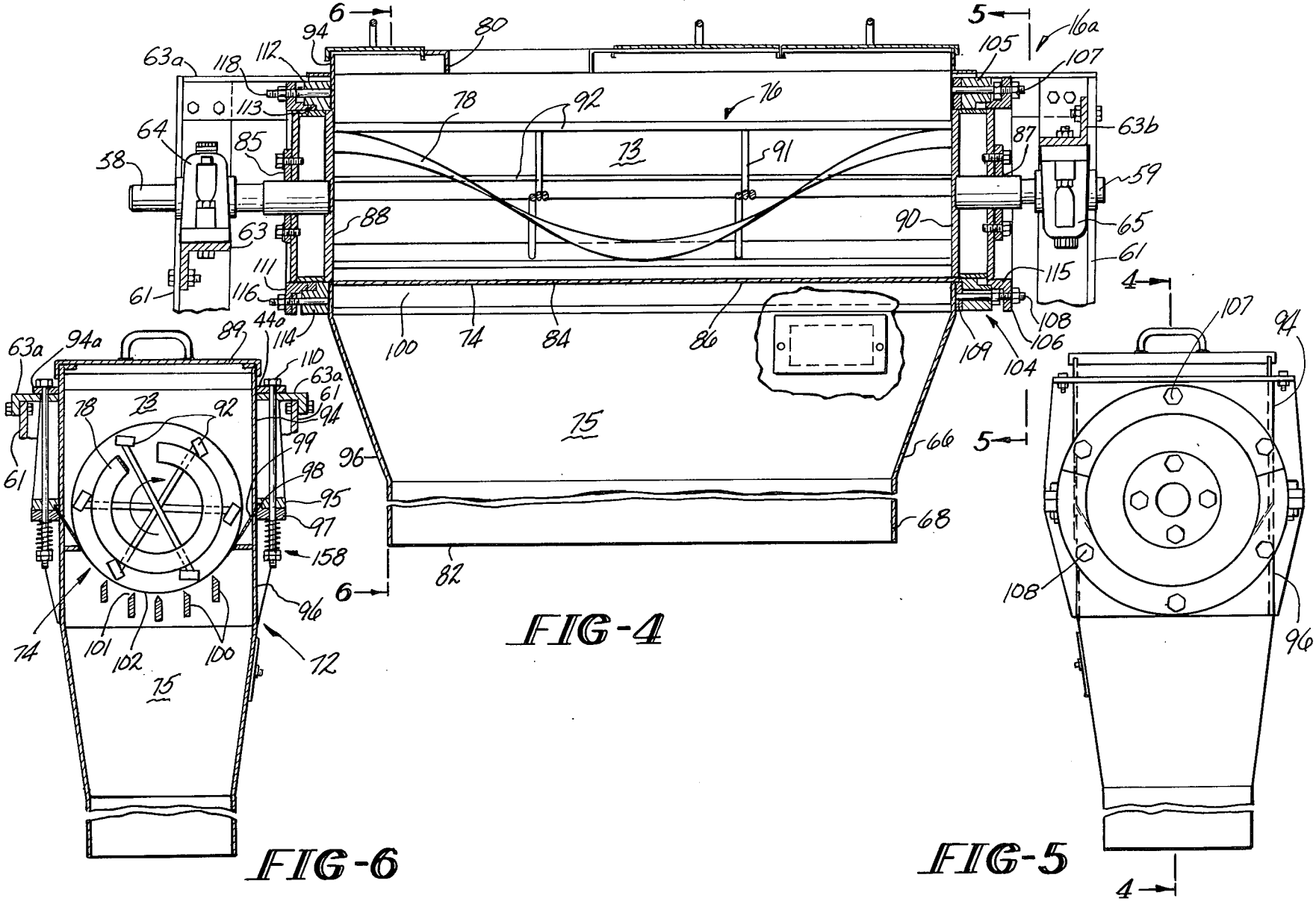
FIG. 4 is a vertical, cross-sectional view along the center line of the granulator of FIG. 3, showing the interior structure thereof.
FIG. 5 is an end view of the granulator taken along lines 5—5 of FIG. 4.
FIG. 6 is a vertical sectional view taken along lines 6—6 of FIG. 4, particularly showing a screen support means.

The driven portion 16*a* of granulator 16 can best be seen with reference to FIGS. 4, 5 and 6. Driven portion 16*a* comprises housing 72, screen 74, beater assembly 76 and deflector 78. Housing 72 comprises upper portion 94 and lower portion 96 and top cover 89. Upper portion 94 and lower portion 96 can include external flanges 95 and 97, respectively, for connection of upper portion 94 to lower portion 96 and for other purposes described below. Upper portion 94 serves to define an inlet region 73 while lower portion 96 and chute 66 serve to define an outlet region 75. Top cover 89 has an opening 80 therethrough leading from feed chute 44 to inlet region 73. Outlet region 75 leads to the interior of dryer 18 so as to deposit granulated material onto trays 32. Flanges 96 and 97 can be provided with a keyway 98 for holding screen 74 as described below. Lower portion 96 includes outlet chute 66 and chute extension 68 as above described, leading to an outlet 82 at the bottom thereof. Lower portion 96 also includes a plurality of support ribs 100 for supporting an intermediate portion 102 of screen 74. Support ribs 100 preferably have beveled upper edges 101 to minimize the blockage of the openings of screen 74. Lower portion 96 is preferably of rectangular horizontal cross-section with support ribs 100 running lengthwise and horizontal.

Figure 11:
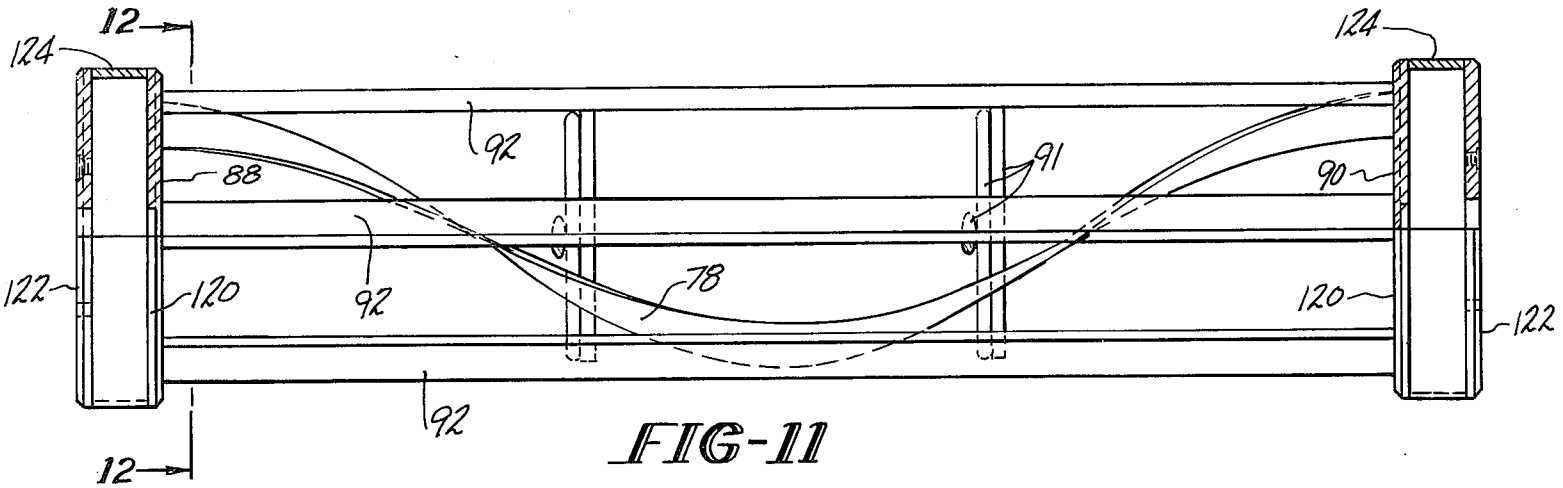
FIG. 11 is a front elevational view of the beater bar assembly of FIG. 4 with an upper portion shown in section.
Figure 12:
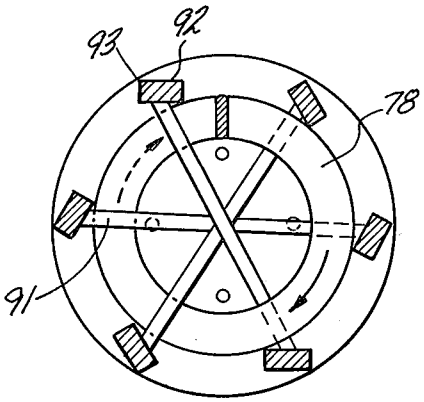
FIG. 12 is a vertical, cross-sectional view taken along lines 12—12 of FIG. 11.
Figure 15:
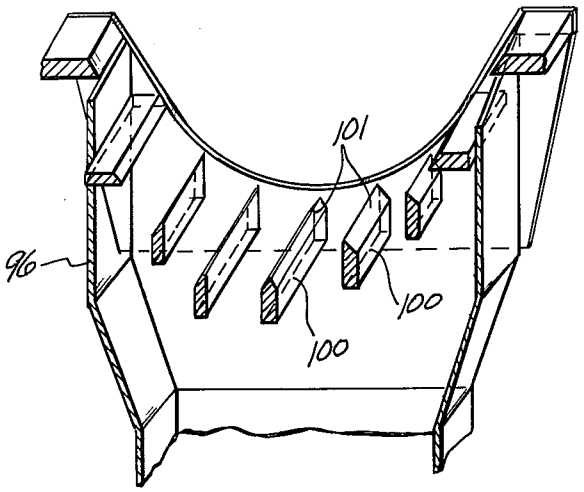
FIG. 15 is a side perspective sectional view of the screen support of FIG. 6, showing greater detail thereof.

Beater assembly 76 includes a first end plate 88, a second plate 90, spokes 91 and beater bars 92. Beater bars 92 are horizontally placed equidistant about a central axis coaxial with the axis of driven shaft 58. In order to support beater assembly 76, a second driven shaft 59, supported by a second bearing 65, is attached to second end plate 90. Bearing 65 is supported by framework 60 in the same manner as bearing 64 except inverted to allow removal of screen 74. In order to minimize the blockage of inlet region 73, beater assembly 76 has no central shaft, but rather is of the shape of a horizontal cage. Spokes 91 serve to support and position beater bars 92. Beater bars 92 provide sharp cutting edge 93 which can be hardened. Edges 93 can also be provided with an insert to lengthen the life of beater bars 92 when subjected to the corrosive and abrasive forces inherent in granulation of calcium hypochlorite. Beater bars 92 can also be of shapes, for example, triangular or hexagonal, other than rectangular, so long as a sharp cutting edge 93 is provided to give the desired cutting action. The insert of cutting edge 93 could be of an abrasion and corrosion resistant material such as Hastelloy C-276® manufactured by the Stellite Corporation. The front or leading surface of beater bars 92 could be an inclined L-shaped surface produced by inclination of a rectangular bar utilized as beater bar 92. Such an L-shaped surface would tend to divide the material which it contacts into a downwardly directed portion and an upwardly directed portion. The downwardly directed portion would then be compressed and directed toward cutting edge 93. The other portion would be lifted upwardly towards deflector 78 for deflection to another location. In this way, the amount of material passing through any portion of screen 74 is controlled. Any excessive material at a given location will tend to be lifted upwardly and deflected to another location. Beater assembly 76 is positioned with its upper half in upper portion 94 and its lower half in bottom portion 96 by means of the mounting of both bearings 64, 65 and upper portion 94 on framework 60 and the attachment of end plates 88 and 90 to flanges 85 and 87 of shafts 58 and 59 respectively. Upper portion 94 has lateral flanges 94*a* which lie atop rails 63*a* of framework 60. Flanges 85 and 87 serve to transmit torque from shafts 58 and 59 to the beater assembly. In order to have a flush surface exposed to inlet region 73, end plates 88 and 90 are drum-shaped, as best seen in FIG. 11. End plates 88 and 90 each comprise an inner plate 120, an outer plate 122 and a ring 124 therebetween. Flanges 85 and 87 are each bolted, or otherwise connected, on the outer plates 122. Thus, the connecting bolts are exposed to the interior of end plates 88 and 90 rather than inlet region 73. Also, rings 124 provide a seating surface for sealing member 113. In the event that the clearance between rings 124 and flanges 111 and a screen flange 104, below described, is sufficiently small to preclude excessive leakage of granules therebetween, sealing member 113 can be eliminated advantageously in order to minimize any localized heating that might be caused by the friction between rings 124 and flanges 111 and 104.

A deflector 78 is provided within heater assembly 76 in order to give a desired product distribution across outlet 82 such that the product will be uniformly distributed across wedge-shaped tray 32 therebelow. Deflector 78 can be a helical ribbon-shaped member attached to beater bars 92 along their interior edges, the edges closest to the central axis of beater assembly 76, and serves to move granules from a first location 84 atop screen 74 to a second position 86 horizontally spaced therefrom and also atop screen 74. Deflector 78, being positioned inside of beater bars 92, primarily moves only material above the level of the leading edges of beater bars 92 when beater bars pass closest to screen 74, since the upper leading surfaces (unnumbered) of beater bars 92 will then lift any such material upwardly onto deflector 78.

In order to more easily remove screen 74, a novel attachment system is utilized. Screen 74 is provided with a screen flange 104, as best seen in FIG. 7. Flange 104 is split into an upper section 105 and a lower section 106. Sections 105 and 106 are each provided with openings adapted to receive upper bolts 107 and lower bolts 108, respectively. Bolts 107 and 108 serve to attach flange 104 to upper portion 94 and lower portion 96 of housing 72, respectively. The purpose of splitting flange 104 is to allow screen 74 to be removed more readily. The split flange 104 eliminates the need to disassembly shafts 58 and 59 in order to remove the screen 74. A stiffener ring 109 can be utilized to give added rigidity to screen 74 and could be placed between flange 104 and housing 72. A packing or sealing member similar to 113 could be added between flanges 104 and a packing gland flange 115 to provide a seal between flanges 104 and end plate 90. Flange 115 is also split in a manner conforming to the split of flange 104 of screen 74 so as to allow screen 74 and lower section 105 to be removed without removal of shaft 59 from its normal operating position. Ring 109, being between flange 104 and portion 96, would not interfere with this procedure. Flange 111 would be split into upper section 112 and lower section 114 in order to allow removal of flange 111 without disassembly of shaft 58. Flange 111 would be attached to upper portion 94 by upper bolts 118 and to lower portion 96 by lower bolts 116 in the same manner as above described with reference to bolts 107 and 108.

Figure 13:
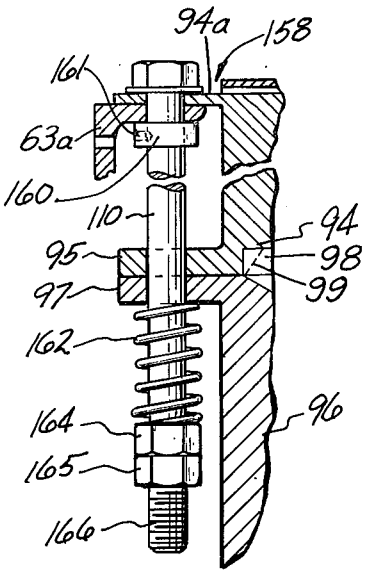
FIG. 13 is a vertical, cross-sectional view of the retractor means of FIG. 6.

With reference to FIGS. 6 and 13, a retractor means 158 is provided in order to allow limited movement of lower housing 96 relative to upper housing 94 and thereby allow limited movement of screen 74 relative to beater assembly 76. Retractor means 158 would include bolts 110 passing through flanges 95 and 97 as best seen in FIG. 13. Upper portion 94 includes upper flange 94*a* in addition to flange 95. Upper flange 94*a* is adapted to rest atop crossbar 63*a* of framework 60 so as to support upper portion 94 relative to dryer 18. Bolt 110 passes downwardly through upper flange 94*a*, flange 95 and flange 97. A set collar 160 can be positioned about bolt 110 immediately below crossbar 63*a* in order to limit upward movement of bolt 110 relative to crossbar 63*a*. A spring 162 and adjusting nuts 164 and 165 can be provided on the portion of bolt 110 extending below flange 97 in order to bias portion 96 upwardly toward upper portion 94. Spring 162 is of sufficient stiffness to maintain upper portion 94 in contact with lower portion 96 during normal operation of granulator 16. However, spring 162 is of sufficient resilience to allow lower portion 96 to move downwardly away from upper portion 94 in response to a predetermined force exerted downwardly on lower portion 96, such as would be the case when beater bars 92 were pressing with great force against an object between bars 92 and screen 74. The downward radial force on screen 74 together with the longitudinal restraint imposed by flange 104 and bolts 108 prevents screen 74 from being released during this procedure. In this way, granulator 16 is provided with means for increasing the clearance between beater bars 92 and screen 74 in response to tramp metal or other foreign objects being dropped into inlet region 73. The force exerted by spring 162 upon lower portion 96 can be adjusted by rotation of adjusting nuts 164 and this force maintained constant by abutting adjusting nut 165 against adjusting nut 164 to lock adjusting nut 164 at a given position upon threads 166 of the lower end of bolt 110.

Referring now to FIGS. 7, 8, 9 and 10, screen 74 is a parabolic, perforated sheet, preferably of metal, preferably having tapered openings 103 therethrough. Openings 103 are tapered toward inlet 73 so that clogging is lessened. The number and size of openings 103 would be determined by the size of granules desired. A suitable taper has been found to be 30° and a suitable opening to be ¼ inch. Screen 74 is shaped to fit within lower portion 96 of housing 72 and be supported by ribs 100. Screen 74 has its upper edges 99 held within keyway 98 of flange 96 so as to allow screen 74 to be slidedly removed from granulator 16 when desired. Screen 74 is also provided with split flange 104, as above described. Thus, screen 74 can be removed by simply unbolting bolts 108 loosening bolts 110 slightly and sliding screen 74 out of the right end of granulator 16 and below crossbar 63*b* as shown in FIG. 4.

Figure 14:
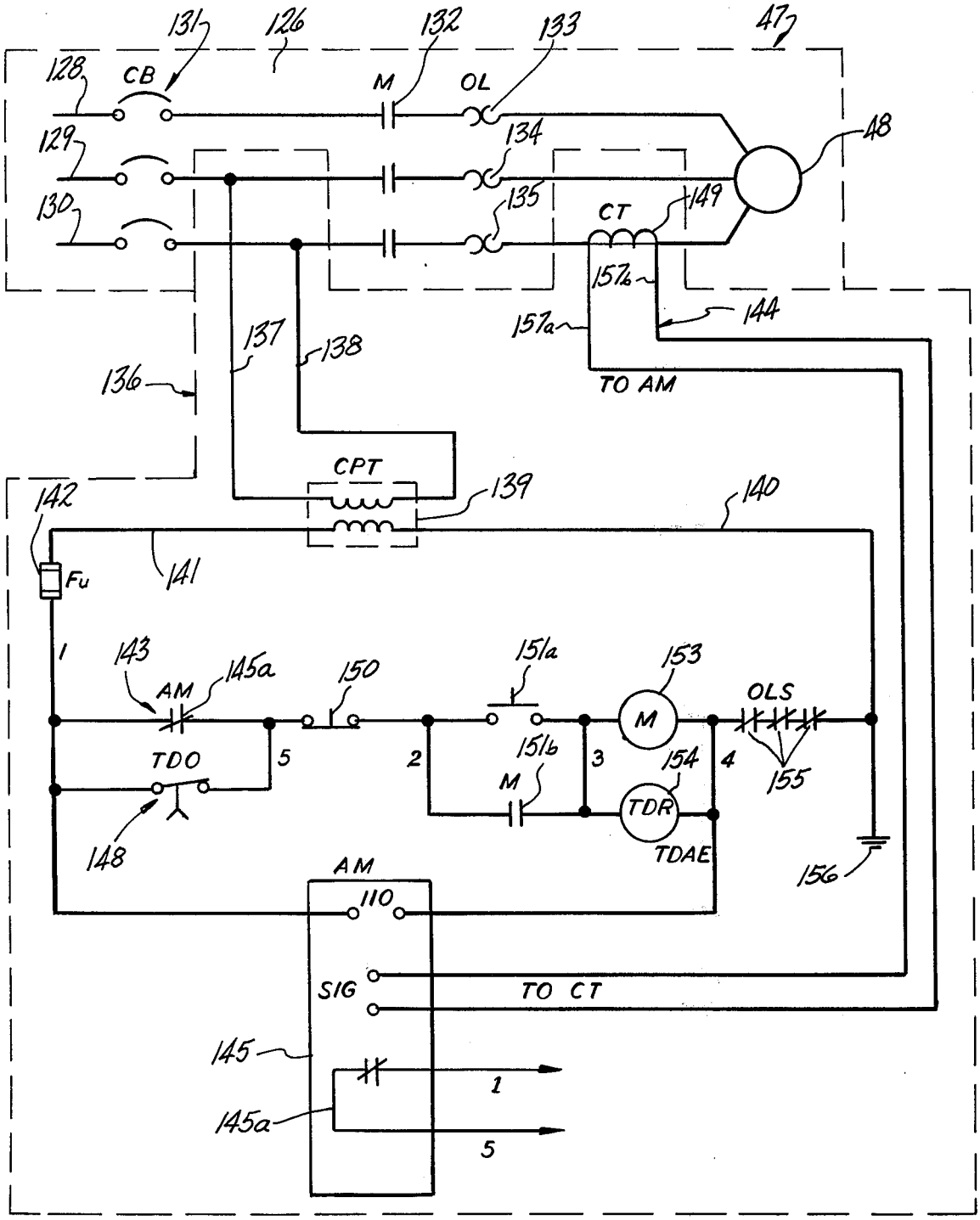
FIG. 14 is an electrical circuit diagram showing the electrical circuitry of the preferred embodiment of the invention.

Referring now to FIG. 14, the drive circuit 47 of granulator 16 will now be described. Drive circuit 47 includes power circuit 126 and control circuit 136. Power circuit 126 comprises motor 48, three leads 128, 129 and 130, a three-pole circuit breaker 131, manual shut-off switches 132 and overload fuses 133, 134 and 135. Leads 128, 129 and 130 provide power to both the motor 48 and the control circuit 136 in the manner described below. Circuit breaker 131 provides a means for opening the power circuit 126 in the event excessive current is entering power circuit 126. Manual switches 132 provide a means for manually opening and closing the power circuit 126. Overload fuses 133, 134 and 135 provide an additional means for breaking power circuit 126 in case of excessive current therethrough. In short, power circuit 126 is a conventional three-pole electrical power circuit for conventional electric motor 48. Control circuit 136 includes primary power leads 137 and 138, control power transformer 139, ground lead 140, secondary power lead 141, main loop 143, pickup loop 144 and contact making ammeter 145. Primary power lead 137 is joined to lead 129 at a point between circuit breaker 131 and manual shut-off switch 132 so as to provide a continuous current therethrough when circuit breaker 131 is in the on or closed position. Primary power lead 138 is similarly joined to lead 130 between circuit breaker 131 and manual shut-off switch 132 in order to complete a takeoff loop to the primary side of transformer 139. The secondary loop of power transformer 139 is connected to secondary power lead 141 and ground lead 140. Secondary power lead 141 provides current through a fuse 142 to main loop 143 and to contact making ammeter 145. Main loop 143 comprises a switch portion 145*a* of contact making ammeter 145, time delay opening relay 148, stop switch 150, start switch 151*a* and main switch 132, starter switch coil 153, time delay actuator 154 and overload switches 155. Contact making ammeter 145 and time delay opening relay 148 are connected in parallel to secondary power lead 141 and to a first terminal of stop switch 150. The second terminal of stop switch 150 is connected to a first terminal of starter switches 151*a* and 151*b*. Starter switch 151*a* is a manual contact making switch (e.g. "start" button) to provide current to coil 153 in order to energize coil 153 so as to close main switch 132 and maintain switch 132 in the closed position after starter switch 151*b* is reopened upon manual release thereof. Time delay actuator 154 provides the magnetic forces to open time delay opening relay 148 a predetermined time after switch 151*a* is closed. Overload switch 155 serves to protect main loop 143 from damage due to excess current. Time delay actuator 154 and coil 153 are connected through overload switches 155 to ground 156 to complete main loop 143. Contact making ammeter 145 is a conventional electrical device commercially available and serves to open main loop 143 in the event excessive current passes from lead 130 to motor 48 after relay 148 has opened. Contact making ammeter 145 is connected to pickup loop 144 in order to sense such excess current. Pickup loop 144 includes a pickup transformer 149 and two leads 157*a* and 157*b*, each attached to a signal terminal of ammeter 145, power lead 141, a ground lead 140 and ground 156. The numeral 110 between leads 140 and 141 indicates that conventional 110–120 volt AC current flows through leads 140 and 141 to ammeter 145. The connections to power lead 141 and ground 156 provide power to ammeter 145 so long as circuit breaker 131 remains closed or "on". Transformer 149 serves to transmit a signal through leads 157*a* and 157*b* to ammeter 145 which is proportional to the amount of current passing to motor 48 from lead 130. Ammeter 145 will open switch portion 145*a* to open main loop 143 when this signal exceeds a predetermined magnitude for a predetermined time period. Upon the opening of main loop 143, current to coil 153 is interrupted so switch 132 opens to shut off motor 48 is shut off by contact making ammeter 145. Thus, if a foreign object enters inlet region 73 and becomes lodged between beater bars 92 and screen 74, ammeter 145 will shut off motor 48 due to excessive current that would be required to drive motor 48 and beater assembly 76 with such material lodged against screen 74.

With the above detailed structure in mind, the operation of granulator 16 will now be described by way of example, and not by way of limitation.

Referring to FIG. 1, moisture-laden calcium hypochlorite passes through preform rolls 12 and into granulator 16 as described above. Such material enters opening 80, as seen in FIG. 4 and passes downwardly through inlet region 73. The material is either deflected by deflector 78, spokes 91 or bars 92 during its downward passage through inlet region 73 or falls to screen 74 where it is contacted by beater bars 92 and forced through screen 74. Once the material passes through screen 74, it enters outlet region 75 where it falls out of outlet 82 and onto one or more trays 32 lying therebelow. The action of deflector 78 tends to move material entering entrance 80, which would otherwise tend to accumulate about first position 84, toward second position 86 above the wide end of trays 32. This movement is such as to produce a uniform distribution of material on trays 32. Due to the wedge shape of trays 32, it is necessary that the distribution of material in inlet region 73 and also within outlet region 75 be greater at the portion of screen 74 which lies above the wider ends of trays 32. Deflector 78 serves to accomplish this purpose.

While the above generally describes the normal operation of granulator 16, foreign objects such as bolts, tools and other metallic or hard objects may be inadvertently introduced, along with the normal calcium hypochlorite, into inlet region 73 and contact beater bars 92 and screen 74. This has been a source of operating failure in past granulators and, therefore, means have been provided in granulator 16 to avoid such damage. In particular, an overload ammeter 145 has been included within drive circuit 47 so as to shut off motor 48 in the event excessive current is being drawn by motor 48. Such excessive current can be the result of either "blinding" or "clogging" of screen 74 or can be the result of a hard foreign object being lodged between beater bars 92 and screen 74. An additional precaution against damage due to foreign objects is provided by the beater bar design of granulator 16 which allows for relatively low speed rotation of beater assembly 76 in contrast to the "hammer-mill" type of granulators previously utilized. This low speed rotation results in much lower impact forces between beater bars 92 and any material entering into region 73. Thus, foreign objects are not thrown violently against screen 74 but rather tend to be pushed aside or over beater bars 92. An additional preventive means is the attachment of shaft 58 or 50 to its respective sprocket 56 or 52 by a shearable connection so that any high impact force upon beater bars 92 will cause the drive means 46 to be quickly inactivated. Yet another preventive mechanism preferably incorporated in granulator 16 is the retractor means 158 above described. It will be understood that screen 74 and lower portion 96 as a unit are allowed to move downwardly with respect to beater bars 92 in response to a predetermined downward force applied to screen 74 or lower portion 96 of housing 72. Thus, any foreign object being lodged between beater bars 92 and screen 74 will result in downward movement of screen 74 so as to increase the clearance between beater bars 92 and screen 74.

As will be appreciated by those of ordinary skill in the art of granulation of materials, other embodiments will be readily suggested. For instance, deflector 78 could be replaced by multiple deflectors or by inclination of beater bars 92 relative to the axis of beater assembly 76, although such could be more expensive. The drive means 46 could utilize a belt drive, gear drive or any other suitable power drive mechanism for transmitting power to driven portion 16*a*. Although screen 74 is described as parabolic, it could be any other shape, e.g. semi-circular, which would provide suitable granulated product under normal operations. The claims below are to be read so as to include these and other equivalents which suggest themselves to ordinarily skilled artisans.

What is claimed is:

1. In a granulator having:
   a. a housing means, having an entrance and an exit, for defining a granulation zone therewithin;
   b. screen means, adapted to be attached to said housing, for dividing said granulation zone into an inlet region and an outlet region;
   c. contactor means for repeatedly moving within said inlet zone and toward said screen means so as to contact a portion of any material within said inlet region and exert a force on said portion so as to tend to move said portion through said screen means and into said outlet region, and
   d. retractor means, attached to said housing means, for moving said screen means away from said contactor means responsive to said force reaching a predetermined magnitude, the improvement in said retractor means wherein:
   a. said housing means includes an upper housing and a lower housing;
   b. said contactor means is supported by said upper housing independently of said lower housing;
   c. said screen means is supported by said lower housing; and
   d. said retractor means includes spring means, lying between parts of said upper and lower housings, for yieldably biasing said lower and upper housings toward one another and allowing limited separation of said upper housing from said lower housing when said force reaches said magnitude and for automatically rejoining said upper and lower housings when said force falls below said magnitude.

2. In a granulator having:
   a housing means, having an entrance and an exit, for defining a granulation zone therewithin;
   screen means, adapted to be attached to said housing, for dividing said granulation zone into an inlet region and an outlet region;
   contactor means for repeatedly moving within said inlet zone and toward said screen means so as to contact a portion of any material within said inlet region and exert a force on said portion so as to tend to move a portion of said material through said screen means and into said outlet region, and
   retractor means, attached to said housing means, for allowing movement of said screen means away from said contactor means responsive to said force reaching a predetermined magnitude, the improvement in said retractor means which comprises:
   a. a flange on each of said upper and lower housings;
   b. a bolt passing through each of said flanges, said bolt having a headed end and a threaded end;
   c. an adjustable nut attached to said threaded end; and
   d. a helical spring lying about said bolt and between said adjustable nut and one of said flanges, so as to allow spring biased movement between said one of said flanges and said adjustable nut, said headed end being restrained by the other of said flanges.

3. The apparatus of claim 2 wherein:
   a. said screen means is clamped between upper and lower sections of said housing, and
   b. said retractor means includes separator means for allowing partial separation of said upper and lower sections.

* * * * *